United States Patent [19]

Moreland et al.

[11] Patent Number: 4,964,966

[45] Date of Patent: Oct. 23, 1990

[54] ELECTRODE AND CONSTRUCTION THEREOF

[76] Inventors: Peter J. Moreland, 22 Springbourne, Frodsham Chesire, Great Britain, WA6 6QD; Norman Tattam, 46 Whitchurch Road, Chester, Great Britain, CH3 5QB

[21] Appl. No.: 316,259

[22] Filed: Feb. 27, 1989

[30] Foreign Application Priority Data

Mar. 1, 1988 [GB] United Kingdom ..... 8804859

[51] Int. Cl.[5] ..... C25B 11/04

[52] U.S. Cl. ..... 204/280; 204/290 R; 204/291; 204/292

[58] Field of Search ..... 204/280, 286, 290 R, 204/291–292, 272

[56] References Cited

U.S. PATENT DOCUMENTS 4,181,585 1/1980 Pangborn ..... 204/98
4,422,917 12/1983 Hayfield ..... 204/290 R
4,452,685 6/1984 Woodard, Jr. et al. ..... 204/252
4,486,288 12/1984 Linder ..... 204/291
4,544,464 10/1985 Bianchi et al. .
4,659,448 4/1987 Gordon ..... 204/427

FOREIGN PATENT DOCUMENTS 1443502 7/1976 United Kingdom .
2114158 8/1983 United Kingdom .

OTHER PUBLICATIONS

Dialog Database Search Report for equivalents to Swedish Patent No. 7714773.
Product information sheets for magnetite anodes.

*Primary Examiner*—John F. Niebling
*Assistant Examiner*—Kathryn Gorgos
*Attorney, Agent, or Firm*—Cushman, Darby & Cushman

[57] ABSTRACT

An electrode comprising a first structure of a low conductivity non-metallic material spaced from a second structure of a high conductivity material which acts as a current distributor to the first structure, and a low melting metal or alloy of bismuth between and in contact with the structures.

16 Claims, 2 Drawing Sheets

ELECTRODE AND CONSTRUCTION THEREOF

This invention relates to an electrode, in particular to an electrode made of a material having a relatively poor electrical conductivity, and to the construction of the electrode.

BACKGROUND OF THE INVENTION AND RELATED ART

Metallic electrodes are used in a wide variety of electrochemical applications, and they have been so used for very many years. For example, a metallic electrode may be used as an anode in the cathodic protection of a metallic structure, and the anode may be of the sacrificial type or of the impressed current type. A metallic electrode may be used in a wide variety of electrolytic cells. For example, a titanium electrode coated with a suitable electrocatalytically-active material may be used as an anode in an electrolytic cell in which chlorine and caustic alkali, or alkali metal hypochlorite or alkali metal chlorate, are produced by electrolysis of aqueous alkali metal chloride solution. In the electrolysis, the metallic cathode may, for example, be of steel or of nickel or of a nickel alloy. Other applications of metallic electrodes include use in fuel cells, in metal winning, in electroorganic synthesis, and in metal plating.

In some electrochemical applications, metal electrodes suffer from certain disadvantages, and in particular metal electrodes may tend to be chemically attacked by the medium in which the electrode is used, indeed, the metallic electrode may be consumed at an unacceptably high rate. For this reason, and for other reasons, e.g., the expense and the relative ease of manufacturing the electrodes, electrodes made of non-metallic materials have been developed in recent years. For example, electrodes made of magnetite have been developed which are dense and hard and which, because the iron in the electrode is in a highly oxidised state, are very resistant to further oxidation when used as an anode. Indeed, the magnetite is virtually inert in many applications and at least in this respect functions in the manner of a precious metal. Magnetite electrodes have been developed for use as anodes in cathodic protection applications. Electrodes may also be made of ferrite. Another non-metallic electrode which has recently been developed for a wide variety of electrochemical applications, including use as an anode in cathodic protection applications, is a ceramic-like electrode formed of a solid coherent bulk titanium oxide having the general formula $TiO_x$, where x is a number in the region 1.67 to 1.9. An electrode of this latter type is described in European Patent No. 47595 and in U.S. Pat. No. 4,422,917. The electrode, which is sold under the trade name 'Ebonex' by Ebonex Technologies Inc., has a particularly desirable combination of properties, namely relatively high electrical conductivity, a high chemical resistance, and good anodic and cathodic electrochemical stability. The electrode is particularly stable in acid environments. Other electrodes which consist of titanium oxide are described, for example, in GB Patent No. 1443502 in which there is described an electrode which may consist of bulk $TiO_x$ in which x is in the range 0.25 to 1.50, and is preferably 0.42 to 0.60.

Although non-metallic electrodes generally have high chemical stability, such electrodes generally have electrical conductivities which are not as great as the electrical conductivities of metallic electrodes, and these relatively low electrical conductivities do lead to some problems in use. Thus, as a result of the relatively poor electrical conductivity, the current distribution in a non-metallic electrode may be relatively poor with the current flow through the electrode progressively decreasing with distance from the point of electrical connection, and indeed, in a non-metallic electrode of relatively large size, there may be a very low or negligible flow of current at a point remote from the electrical connection. The electrical current will of course flow along the path of least electrical resistance, and the current may pass into the environment adjacent to the electrode rather than distribute itself throughout the electrode. Such relatively poor current distribution can itself lead to problems in that there may be localized areas of high current density on the surface of the electrode which may result in damage to the electrode and a reduction in the useful life of the electrode.

Various solutions to this problem of poor current distribution in non-metallic electrodes have been proposed. In general, these solutions involve laminating the non-metallic electrode to, or coating the non-metallic electrode with, a metal of low electrical resistivity. In WO No. 8303264-A there is described a tubular magnetite electrode for use in impressed current cathodic protection which has an internal coating of electrically conductive metal alloy to which an electrical connection is made. The coating may be of copper, lead, tin or aluminium, or of alloys thereof. Similarly, Swedish patent No. 7714773 describes a tubular magnetite anode which has an internal copper lining. A metal oxide electrode for use in cathodic protection in the form of a hollow tube which has a coating of an electrically conductive metal or alloy is also described in U.S. Pat. No. 4,486,288. The internal coating or lining may be applied to the tube by electroplating, but we have found that such electroplating is technically rather difficult to effect and may result in a poorly bonded coating or lining. Furthermore, if the coating or lining is to act as an efficient current distributor, a relatively thick coating or lining is required and such a thick coating or lining may take a substantial time to apply.

In GB Patent No. 2114158 there is described a tubular electrode which consists of a sintered mixture of ferrite and one or more oxides of Mn, Ni, Co, Mg, Cu, Zn, or Cd. The tube has one end open and one end closed and a metal member, which may be, for example, a bar of stainless steel, inserted into the tube and fixed to the tube by means of an electrically conductive material.

The present invention relates to an electrode which comprises a non-metallic material of relatively low electrical conductivity, which is simple to construct, and which in use shows excellent current distribution over the surface of the electrode.

SUMMARY OF THE INVENTION

According to the present invention, there is provided an electrode which comprises a first structure comprising an electrically conducting non-metallic material which is of relatively low electrical conductivity, a second structure spaced from the first structure and which is of relatively high electrical conductivity and which acts as a current distributor to the first structure, and between the said structures and in contact therewith a solid low melting point electrically conducting metal or alloy.

By relatively low electrical conductivity and relatively high electrical conductivity, we mean merely that the first structure has a low electrical conductivity such that the distribution of electrical current supplied to the structure from a point thereon at which an electrical connection is made is relatively poor, and that the electrical conductivity of the second structure is greater than that of the first structure such that the second structure assists in distributing electrical current to the first structure. The electrical conductivity of the solid low melting point metal or alloy which is between the structures and which is in contact therewith will generally, but not necessarily, be greater than that of the first structure. Suitable electrical conductivities for the first and second structures and for the solid low melting point metal or alloy will be described hereafter.

DETAILED DESCRIPTION OF THE PREFERRED EMBODIMENTS

Figure 1:
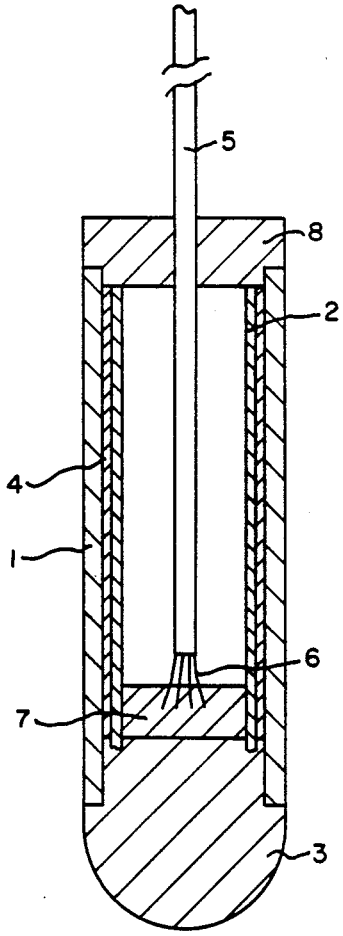

The electrode of the invention may have various forms of construction. For example, it may have a sheet-like form such as a plate, but it preferably has a tubular form as it is in this latter form that the electrode finds it greatest uses, particularly as an anode in cathodic protection applications. In such a tubular form of electrode, the first structure is in the form of a tube which will generally have a wall thickness of at least 1 mm, and which may have a wall thickness of as much as 10 mm, although it is to be understood that these dimensions are by way of example only and are not meant to be limiting. In the tubular form of electrode, the second structure will generally be positioned within the first structure, in which case the second structure, which may have the form of a tube, or rod, and preferably the form of a tube, will clearly have an outer dimension which is somewhat smaller than the internal dimension of the first structure. In general, the second structure will be spaced from the first structure by a distance of at least 0.1 mm, and preferably at least 0.5 mm. The spacing will generally not be greater than 3 mm. The wall thickness of the second structure, when in the form of a tube, is preferably at least 0.5 mm, and it may be, for example, as great as 5 mm. The overall length of the tubular form of electrode may be, for example, at least 5 cm, but it will often be much greater, depending of course on the use to which the electrode is to be put. The electrode may have an overall length of 0.5 meter or greater, particularly when it is to be used in a cathodic protection application, and it is particularly important with an electrode of such length that the problem of poor current distribution throughout the length of the electrode should be overcome, as is the case with the electrode of the present invention.

Where the electrode has a structure which is different from the tubular form, for example a plate-like form, the thicknesses of the first and second structures and the spacing thereof, may be the same as the corresponding dimensions of the first and second structures in the tubular form of electrode.

The first structure comprises an electrically conducting non-metallic material, and it may consist essentially of such a material. Suitable non-metallic materials include magnetite, which may be represented as $FeO\text{-}Fe_2O_3$, and ferrite, which may be represented as $MO\text{-}Fe_2O_3$, where M is a divalent metal, e.g. Mn, Ni, Cu, Mg, Co or Zn. Another suitable non-metallic material is a titanium oxide of general formula $TiO_x$ in which x is less than 2. A preferred titanium oxide, on account of its good combination of electrical conductivity and chemical resistance, is that in which x in $TiO_x$ is in the range 1.67 to 1.9, as described in U.S. Pat. No. 4,422,917. The non-metallic material will generally be in the form of a structure of sintered particles, as described for example in the aforementioned U.S. Pat. No. 4,422,917. The first structure may comprise materials other than the electrically conducting non-metallic material. For example, it may comprise a metal or metals, especially in a particulate form distributed throughout the structure, although the presence of such metals may not be favored in certain applications of the electrode as their presence may adversely affect the chemical resistance of the structure. The first structure may additionally comprise materials which are essentially electrically non-conducting, e.g. metal oxides, carbides or nitrides in order to improve or modify the physical or mechanical properties of the structure.

The electrical conductivity of the non-metallic material of the first structure will clearly be less than that of metals which are commonly used as electrodes, otherwise there would be no necessity for the present invention. Thus, the electrical conductivity of the non-metallic material will be less than that of copper ($6\times10^5$ $ohm^{-1}$ $cm^{-1}$), iron ($1.03\times10^5$ $ohm^{-1}$ $cm^{-1}$), titanium ($2.4\times10^4$ $ohm^{-1}$ $cm^{-1}$), and of nickel ($1.46\times10^5$ $ohm^{-1}$ $cm^{-1}$). In general, the electrical conductivity of the non-metallic material will be less than $10^4$ $ohm^{-1}$ $cm^{-1}$, and it may be as low as 10 $ohm^{-1}$ $cm^{-1}$ or possibly even lower.

The second structure is made of a material which is of relatively high electrical conductivity. Although it may be made of a non-metallic material, the second structure is preferably made of a metallic material having a high electrical conductivity in order that the second structure should be able to act as an efficient distributor of electrical current to the first structure, particularly when in the form of structure of relatively thin cross-section, e.g. when in the form of a thin-walled tube within a tubular first structure. Suitable materials for the second structure include the copper, iron, titanium and nickel as hereinbefore referred to. Copper is a preferred material as it is cheap and readily available and has a high electrical conductivity, and is readily available in a tubular form suitable for use in a tubular form of electrode.

In the electrode the space between the first and second structures, e.g. the annular space between the first and second structures in a tubular electrode contains a low melting point metal or alloy which is electrically conducting and which is in contact with the structures. The metal or alloy is solid, that is it is solid at the temperature of use of the anode.

In general the metal or alloy will have a melting point of greater than 30° C. preferably greater than 50° C. The metal or alloy preferably has a relatively low melting point, e.g. a melting point of 200° or less, or even of 100° C. or less, as such a relatively low melting point assists in production of the electrode. The electrical conductivity of the metal or alloy need not be particularly high as in the electrode electrical current is required to be conducted only across the thickness of the metal or alloy between the first and second structures. As a matter of practice the electrical conductivity of the metal or alloy will generally be relatively high, for example, greater than $10^3$ $ohm^{-1}$ $cm^{-1}$, and often greater than $10^4$ $ohm^{-1}$ $cm^{-1}$, as relatively high electrical conductivity, assists in distributing electrical current to the first structure.

Any suitably low melting point electrically conducting metal or alloy may be used. However, it is preferred to use a solid low melting point metal or alloy which expands after solidification and which continues to expand for some substantial period of time after the metal or alloy has solidified during construction of the electrode. Such expansion and continued expansion not only assists in making good contact, and particularly good electrical contact between the first and second structures, it also assists in bonding of the metal or alloy to the first and second structures. Good bonding is preferred where an electrode of high mechanical strength is required. Many bismuth-containing alloys possess this property of expanding after solidification, and furthermore, they may expand by an amount greater than the thermal contraction experienced by the metal or alloy on cooling, thus, providing particularly good electrical contact between the first and second structures. For this reason bismuth-containing alloys are preferred. Examples of suitable bismuth-containing alloys include alloys of bismuth with lead, with tin, with lead and tin, and with lead, tin and cadmium.

Suitable bismuth-containing alloys include the following:

| Metal or alloy | Electrical Conductivity $ohm^{-1} cm^{-1}$ | Melting point °C. |
|---|---|---|
| Bi/Sn | $1.7 \times 10^4$ | 138 |
| Bi/Pb | $1 \times 10^4$ | 124 |
| Bi/Pb/Sn/Cd | $2.2 \times 10^4$ | 72 to 98 |

Many bismuth-containing alloys may contract for a short period after solidification, but thereafter, they begin to expand, and indeed many such alloys continue to expand for 12 months or more after solidification. The linear expansion of the alloy may be, for example, greater than 0.2% and it may even be as much as 1% or greater.

The first structure may be porous, for example when in the form of sintered particles of non-metallic material, and prior to construction of the electrode, the porous first structure may be impregnated, for example, with a thermosetting resin, e.g. a polyester resin or an epoxy resin, which may subsequently be cured, or with a high melting point wax.

The manner of construction of the electrode will depend at least to some extent on the type of electrode structure. For example, where the electrode has a plate-like structure, the first structure and the second structure may be placed in a suitable frame which spaces apart the structures by the required distance and which seals the space between the structures at the side and bottom edges thereof. Thereafter, the metal or alloy in a liquid form may be poured into the space between the structures and allowed to cool to a solid state. The first and second structures may be heated prior to pouring of the metal or alloy into the space between the structures.

Where the electrode has a tubular form, the second structure in the form of a rod or tube may be placed inside the first structure which is in the form of a tube, the base of the structure may be sealed, e.g. by means of a plug of plastics material, and the metal or alloy in liquid form may be poured into the annular space between the structures and allowed to cool to a solid state. The first and second structures may be heated prior to pouring of the metal or alloy into the annular space between the structures.

In order to assist in the formation of good electrical contact, and in particular a low resistance electrical contact, between the metal or alloy and the first and second structures, and in particular between the non-metallic substrate of the first structure and the metal or alloy, it is preferred that the surface of the first structure which is to be contacted with the metal or alloy is first wetted by contacting the surface with a metal alloy which is liquid at ambient temperature, e.g. at 25° C. A suitably alloy is a gallium/indium/tin eutectic alloy. Further assistance in the formation of a good electrical contact may be obtained by applying a layer of solder to the surface of the second structure.

In a further stage in the construction of the electrode a lead for electrical power is sealed to the surface of the second structure, e.g. by soldering thereto.

When the electrode is used, it may be desirable to shield the second structure from the electrolyte in which the electrode operates, and thus, for example in the case of a tubular electrode, the upper and lower ends of the tubular structure may be sealed, for example by means of plugs, e.g. of plastics material.

The electrode of the invention finds uses in many different types of application, but it is particularly useful in the cathodic protection of metallic structures. For example, it may be used as an anode in the cathodic protection of marine structures, e.g. piers and oil and gas rigs, of buried pipelines, and of buried storage tanks, as well as in many other types of cathodic protection application. In such an application, the electrode is connected to a source of electrical power as is the structure to be protected and the latter structure is cathodically polarized. The electrode may also be used as a cathode in the anodic protection of structures, and it may be used in electrochemcial cells.

DETAILED DESCRIPTION OF THE DRAWINGS

An embodiment of the invention will now be described with the aid of the accompanying FIG. 1 which is a cross-sectional view in elevation of an electrode.

Figure 2:
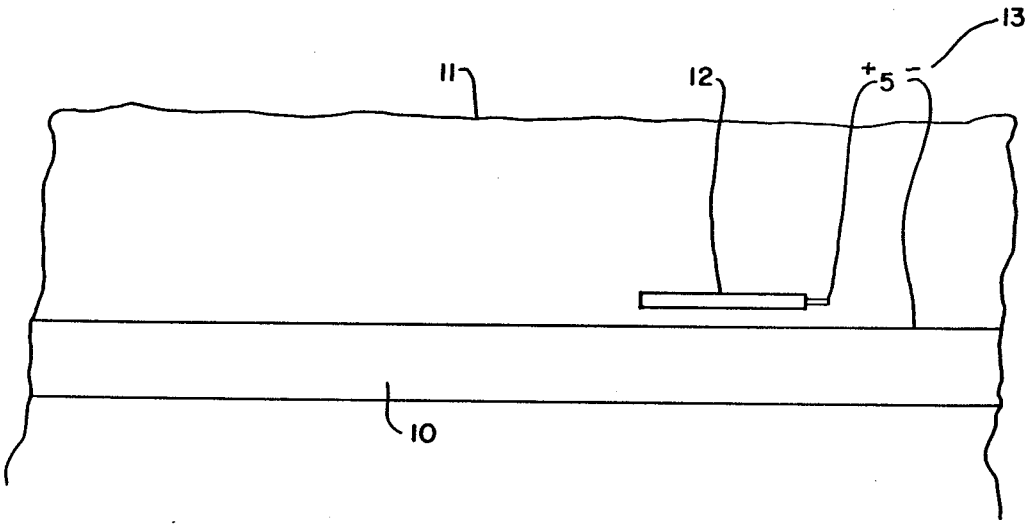

FIG. 2 is a diagrammatic representation of a method of use of the electrode.

The electrode shown in FIG. 1 comprises a tube (1) of sintered particulate titanium oxide $TiO_x$ in which x is 1.75 having an outer diameter of 43 mm and an inner diameter of 37 mm, that is wall thickness of 3 mm. Within this tube, there is positioned a copper tube (2) having a wall thickness of 1.2 mm and an outer diameter of 31.5 mm, the copper tube being spaced from the inner wall of the $TiO_x$ tube (1) by a distance of 2.75 mm. The lower part of the electrode is sealed by a plug (3) of plastics material and the annular space between the $TiO_x$ tube (1) and the copper tube (2) is filled with a low melting point Bi/Sn alloy (4) in liquid form which is then allowed to solidify. Prior to filling of this annular space with the alloy (4) the inner wall of the tube (1) was treated with a gallium/indium/tin eutectic alloy in order to wet the inner surface of the tube. Approximately centrally within the electrode, there is positioned an insulated cable (5) and the copper wires (6) at the end of the cable (5) are sealed in a plug (7) of the same alloy as the alloy (4) which fills the annular space between the tube (1) and the tube (2). The electrode is completed by a plug (8) of plastics material which seals the inside of the electrode from the environment in which the electrode is used.

FIG. 2 illustrates a steel pipeline (10) buried below the surface of the ground (11) and an electrode of the invention (12) positioned in line with the pipeline (10) and spaced slightly therefrom. The electrode (12) is connected to a source (13) of direct electrical current, and the pipeline (10) is similarly connected to the source of direct electrical current. In operation, the electrode (12) is anodically polarized, and the pipeline (10) is cathodically polarized in order to prevent corrosion of the pipeline (10). A plurality of electrodes (12) may be positioned along the length of the pipeline (10) and spaced apart from each other in order to provide cathodic protection for the pipeline.

What is claimed is:

1. An electrode comprising:
(a) a first structure of low conductivity non-metallic material;
(b) a second structure spaced from said first structure which is made of a material of relatively high conductivity; and
(c) a solid, low-melting point, electrically conducting metal or alloy of bismuth disposed between said first and second structures and in electrical contact therewith.

2. An electrode according to claim 1 wherein said first structure comprises magnetite, ferrite or titanium oxide of the general formula $TiO_x$, where x is less than 2.

3. An electrode according to claim 2 wherein said first structure comprises titanium oxide of the general formula $TiO_x$, where x is in the range 1.67 to 1.9.

4. An electrode according to claim 2 wherein said first structure further comprises particulate metal distributed therethrough.

5. An electrode according to claim 1 wherein said second structure comprises copper, iron, titanium or nickel.

6. An electrode according to claim 1 wherein said solid, low melting point, electrically conducting metal is a bismuth containing alloy.

7. The electrode according to claim 1 having a tubular shape.

8. The electrode according to claim 1 having a plate shape.

9. An electrode comprising:
(a) a first structure of non-metallic material having a conductivity less than $10^4$ $ohm^{-1}$ $cm^{-1}$ comprising magnetite, ferrite or titanium oxide of the general formula $TiO_x$, where x is less than 2;
(b) a second structure, spaced from said first structure, made of a material which has an electrical conductivity greater then that of said first structure; and
(c) a bismuth containing alloy disposed between said first and second structures and in electrical contact therewith.

10. An electrode according to claim 9 wherein said bismuth containing alloy is selected from the group consisting of Bi/Sn, Bi/Pb and Bi/Pb/Sn/Cd.

11. An electrode according to claim 9 wherein said second structure comprises copper, iron, titanium or nickel.

12. An electrode according to claim 9 wherein each of the first and second structures is tubular.

13. An electrode having a generally tubular configuration comprising:
(a) a first outer, tubular, structure comprising titanium oxide of the general formula $TiO_x$, where x is less than 2;
(b) a second, inner, electrically conductive structure spaced from said first tubular structure; and
(c) a solid, low-melting point, electrically conducting metal or alloy of bismuth disposed between said first and second structures, and in electrical contact therewith.

14. An electrode according to claim 13 wherein said second structure comprises a rod.

15. An electrode according to claim 13 wherein said second structure comprises a tube.

16. An electrode according to claim 13 wherein said first structure comprises titanium oxide of the general formula $TiO_x$, where x is in the range 1.67 to 1.9.

* * * * *